United States Patent [19]

Swiger

[11] 4,033,662

[45] July 5, 1977

[54] ELECTRICAL CONNECTOR

[76] Inventor: James W. Swiger, 1015 Heatherwood Road, Bluefield, W. Va. 24701

[22] Filed: Apr. 30, 1976

[21] Appl. No.: 681,823

[52] U.S. Cl. ..... 339/113 R; 339/184 R

[51] Int. Cl.[2] ..... H01R 3/00

[58] Field of Search ..... 339/113 R, 149 R, 149 P, 339/184 R, 186 M, 193 R, 196 R, 196 M

[56] References Cited

UNITED STATES PATENTS

| | | | |
|---|---|---|---|
| 3,351,892 | 11/1967 | Feeser | 339/184 R |
| 3,614,711 | 10/1971 | Anderson et al. | 339/186 M |
| 3,901,574 | 8/1975 | Poullus et al. | 339/113 R |

*Primary Examiner*—Roy Lake
*Assistant Examiner*—DeWalden W. Jones
*Attorney, Agent, or Firm*—J. Gibson Semmes

[57] ABSTRACT

Electrical cable connector comprising receptacle and plug having polarity marking which is integrally disposed in the coactive elements comprising receptacle and plug, characterized by unique means of setting the cables of opposite polarity within the respective components, and by unique means of housing, insulation and locking the components together.

5 Claims, 6 Drawing Figures

100
110
112
114
116
120
122
124
130
140
142
150
152
160
164
166
168
200
210
212
216
220
224
230
240
242
244
246
250
252
300

ELECTRICAL CONNECTOR

DESCRIPTION OF THE PRIOR ART

The prior art is best represented by the patents to Lundy, U.S. Pat. No. 2,424,938 and Cassedy, U.S. Pat. No. 1,978,076 as well as Schork, U.S. Pat. No. 1,830,411. Whereas the concept of creating visible means for polarity identity in receptacles has been previously expressed in the aforementioned, taken together with the patents to Michals, U.S. Pat. No. 2,964,726 and Frank, U.S. Pat. No. 3,255,302, the provision for embedding the respective components comprising receptacle and plug in a substantially safer environment, considering the possibility of blow out and/or reverse polarity connection has not been addressed heretofore. It is with this objective that the various features comprising the combination receptacle and plug connector create novel invention over the known art.

SUMMARY OF THE INVENTION

The invention comprises, in its broadest aspects, unique means for providing receptacle and plug electrical connection wherein the construction is rendered safe against imperfect connection while the components comprising the negative and positive contacts are secured unique against imperfect alignment and setting and wherein the respective cable leads for receptacle and plug may be securely attached to the respective positive and negative contacts of the receptacle and plug.

DESCRIPTION OF THE PREFERRED EMBODIMENTS

Figures 1, 2:
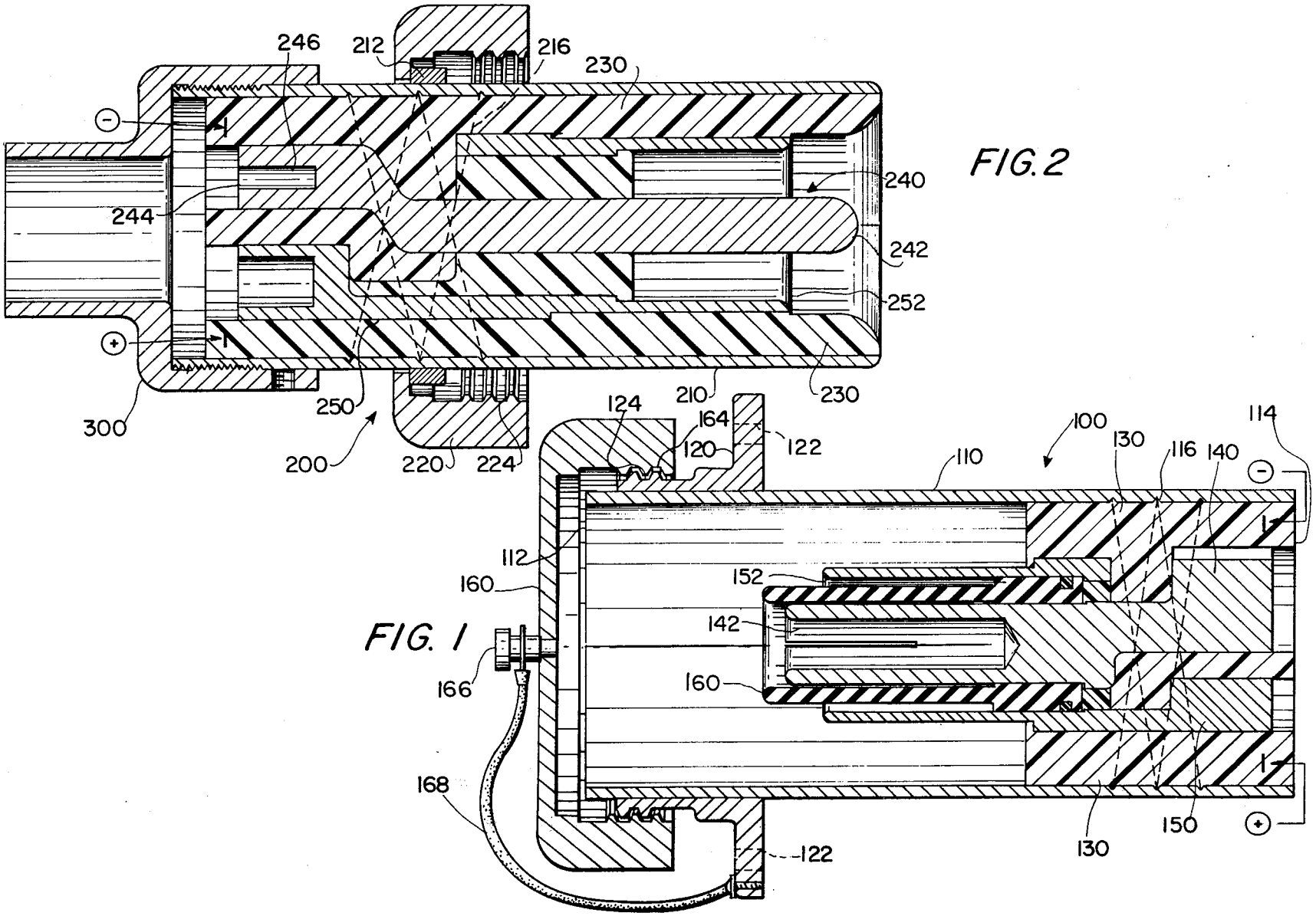
FIG. 1 is a view in vertical section of a receptacle portion of the invention.
FIG. 2 is a view in vertical section of a plug comprising the invention.

With reference to FIG. 1, the receptacle component 100 comprises an outer case 110 having open ends 112 and 114, the interior wall of said case having, adjacent the end 114, plural scores or grooves 116, said grooves forming cross threads as indicated by the phantom line shown. The function of the scoring is to secure a means for anchoring the epoxy resin 130, which, in turn, is used to set the contacts and indicia within the casing, as will be hereinafter described. On the opposite end 112 of the casing 110 and adjacent thereto, there is provided a mounting flange 120, said flange having plural bores 122 extending parallel to the axis of the case, said bores preferably being six in number and spaced at 60° from one another. The flange which is fixed appropriately to the casing, also includes in the portion thereof which is parallel to the casing, the thread 124, said threads being adapted to engage the counterpart of the plug, namely the element 220 hereafter described. And/or the cap 160 when the receptacle is not in use. The cap has threads 164, a cap pin 166 to which is attached a plastic coated retainer cable 168, said cable being anchored to the flange 120, as shown.

The potting material is a transparent epoxy resin, generally illustrated by the numeral 130, said epoxy being adapted to secure the polarity symbols adjacent the end 114 of the receptacle casing, said symbols being embedded for facile observation endwise of the receptacle.

Figure 3:
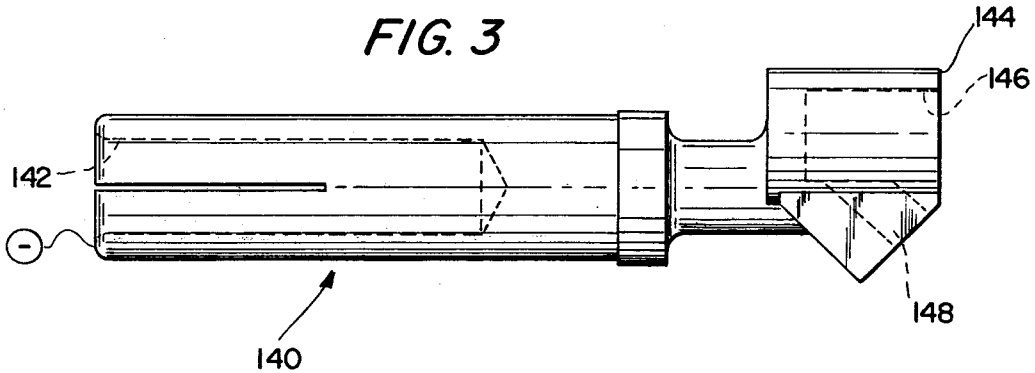
FIG. 3 is a side elevational view of the receptacle negative contact of FIG. 1.

The epoxy resin also sets the negative contact 140 into position, said contact 140 being further illustrated in FIG. 3 as having at the left-hand extremity thereof, the cavity 142.

Within the wall of the shank portion of the receptacle negative contact 140 there are cut plural and opposed slots, said slots being adapted to facilitate friction fit insert of the plus negative element 240, hereinafter described. The receptacle negative contact at its opposite end 144 includes a cable receiving cavity 146, said cavity being in connection with the tap 148, said tap 148 being threaded to adapt a tap screw for securement of the cable within the cavity 146.

Figure 5:
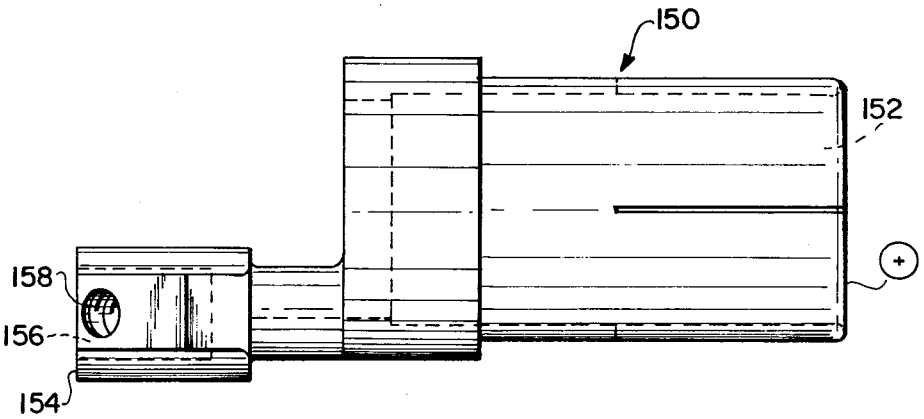
FIG. 5 is a side elevational view of the receptacle positive contact shown in FIG. 1.

Turning now to the receptacle positive contact 150, reference FIG. 5, said positive contact is provided with a corresponding cavity 152 at the receiving end, said cavity having its cylindrical walls slotted at 180° opposites to facilitate the outer positioning and fitting of the plug positive contact 250, hereinafter described. Again, as in the corresponding negative contact of the receptacle, at the opposite end 154 of this positive contact, there is a cavity 156, accommodating a cable terminal with a connecting tap, being threaded for the accommodation of a cable terminal set screw, not shown. In both respective receptacle negative and positive contacts of FIGS. 3 and 5, the taps are preferably set at an angle which is approximately 45° from an imaginary line drawn through the center axis of the respective cable receiving cavities of the contacts.

Figure 4:
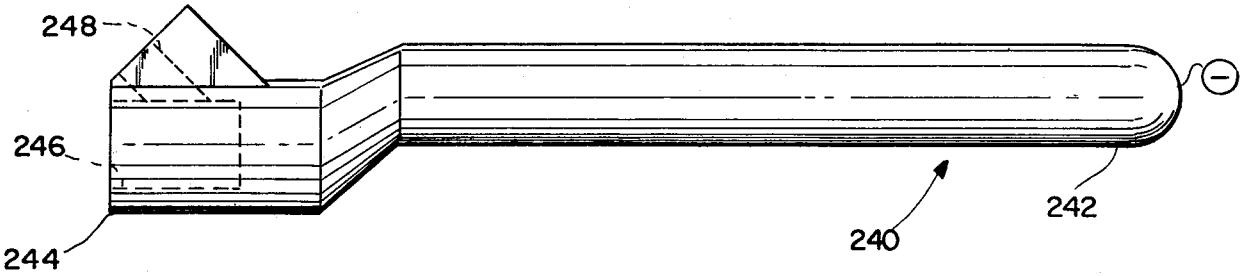
FIG. 4 is a side elevational view of a plug negative element, corresponding to the receptacle negative element of FIG. 2.
Figure 6:
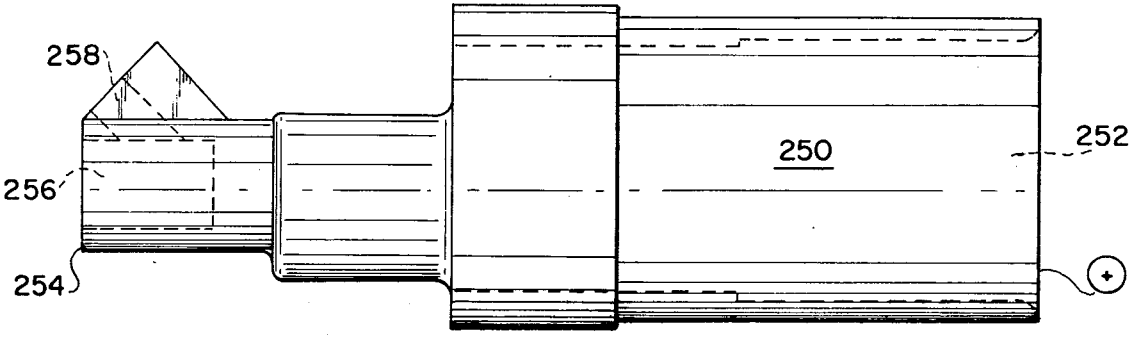
FIG. 6 is a side elevational view of the plug positive contact illustrated in FIG. 2.

Referring now to FIGS. 2, 4 and 6, the plug component 200 is shown. The component 200 includes an outer case 210 having a jam ring 212, intermediate ends of the case, said jam ring anchoring the compression lock ring 220. In the interior wall of the cylindrical wall of the plug element are plural grooves 216, extending peripherally of the interior diameter to provide anchorage for the epoxy resin 230 which is used as potting to secure the plug components into position within the interior of the plug case. The grooves form cross threads as indicated by the phantom line shown. At the left-hand end of the casing, having the epoxy within, there are plural polarity indicia embedded for axial outside observation. Readily aligning the corresponding receptacle and plugs for correct polarity connection is within the stated objectives of invention. Heretofore, the obliteration of exteriorly placed indicia by mud, dirt, grease and oil has presented a dangerous occasion for connection in reverse polarity with consequent blow-out and damage to the electrical systems on the supply and output ends, not shown.

The plug assembly 200 has plug negative contact 240 set within the epoxy resin 230, substantially centrally thereof. The end 242 is adapted for insertion into the corresponding cavity 142 of the negative contact 140 of the receptacle element 100. At the opposite end 244 of the plug negative probe is a cavity 246 accommodating the terminals of a negative cable, the same being secured into position, reference FIG. 4, by means of the tap 248 and an accommodating screw, the tap having appropriate threading for said screw. The angular disposition of the plug negative and plug positive tap screw cavities is substantially the same as in the receptacle contacts, namely at a 45° angle relative to an axial line drawn through the cable cavities of the respective plug negative and plug positive contacts 240 and 250. Referring to the plug positive contact 250, this includes a cavity 252 at the right hand end, the same adapting to the corresponding receptacle positive contact 150. The opposite end 254 of the plug positive contact is the cavity 256, this being adapted to receive the terminal of a cable, the cable being held in situ by the tap screw, not shown, said tap screw being adapted to positioning within the threaded cavity 258, emanating into the corresponding cavity 256.

By reference to FIGS. 1 and 2, it will be appreciated that the plug 200 is adapted to seating within the receptacle 100 and the two connected and secured to each other by means of the respective mounting flange 120 and corresponding lock ring 220, the lock ring having the threaded portion 224 accommodating the corresponding thread 124 of the mounting flange. While not clearly shown, the lock ring is provided with plural projections, emanating from the exterior and upon which the lock ring 220 may be impinged, by hammer. A suitable handle 300 may be optionally applied to a corresponding threaded portion of the plug cable input end.

As indicated, the potting material is preferably a clear epoxy resin. Preferably, the outer case comprises a seamless yellow brass tubing; or seamless aluminum tubing; the respective negative contacts are of cast bronze; the locking ring, handle and mounting flange and cap being fabricated of cast aluminum. Likewise, the respective negative and positive contacts of the receptacle are cast bronze; the inner insulation 160 thereof comprises a canvas based phenolic tubing having an O-ring securing it to positioning within the receptacle positive contact 150.

I claim:

1. Electrical connector adapted to secure corresponding conduits of opposite polarity, comprising:

A. an elongated plug, said plug comprising an outer case wherein respective electrical contacts are housed;

A1. a cylindrical plug positive contact, set axially of the casing, said positive contact having open and closed ends;

A2. a plug negative probe contact set within the housing interiorly of the positive contact;

B. bores at adjacent closed ends of the respective contacts and means engageable with said bores and said conduits to secure conduit sections thereto, B1. an elongated receptacle, said receptacle comprising an outer case wherein respective receptacle contacts are housed;

B2. a cylindrical plug positive contact, set axially of the casing, said plug positive contact having open and closed ends;

B3. a receptacle negative contact, disposed generally axially of the receptacle positive contact, said negative contact having at an open end thereof an axial cavity;

C. insulating means interposed between the respective receptacle negative and positive contacts;

D. transparent potting means securing the respective receptacle and plug contacts within the respective casings and E. polarity indicia set within the respective said receptacle and plugs, adjacent the corresponding positive and negative contacts thereof.

2. The electrical connector of claim 1 wherein said respective plug and receptacle positive and negative contacts each include conduit connection at one end thereof, comprising drill and tap set screw assembly.

3. The electrical connector of claim 1 wherein said drill and tap set screw assembly is disposed substantially at an acute angle coaxially of said receptacle and plug.

4. The electrical connector of claim 1 wherein the said respective casings each include plural scoring, interiorly thereof, forming grooves for retention against displacement of the epoxy resin potting material.

5. Connector for electrical conduits of opposite polarity, comprising:

A. elongated plug, and open-ended casing therefor, including positive and negative contacts, said contacts being set within said plug coaxially thereof;

B. receptacle and open-ended casing therefor, including therein positive and negative contacts, said contacts being set coaxially of the said receptacle; said respective plug and receptacle positive and negative contacts each including conduit connection at one end thereof, forming drill and tap set screw assembly, said drill and tap set screw assembly being disposed substantially at an acute angle coaxially of said receptacle and plug;

C. transparent epoxy resin potting material contained within the respective casings, securing said plug and receptacle contacts therein;

D. opposite polarity indicia means set within the potting material, adjacent ends of corresponding positive and negative contacts of said receptacle and plug.

* * * * *